US010689183B2

(12) United States Patent
Moretti

(10) Patent No.: US 10,689,183 B2
(45) Date of Patent: Jun. 23, 2020

(54) CONTAINER OF FLUID SUBSTANCES WITH HERMETIC SEALING SYSTEM AND METHOD OF USE

(71) Applicant: LUMSON S.p.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 135 days.

(21) Appl. No.: 15/982,546

(22) Filed: May 17, 2018

(65) Prior Publication Data

US 2018/0339845 A1 Nov. 29, 2018

(30) Foreign Application Priority Data

May 24, 2017 (IT) ..... 102017000056451

(51) Int. Cl.
*B65D 83/42* (2006.01)
*B05B 11/00* (2006.01)
(Continued)

(52) U.S. Cl.
CPC ..... *B65D 83/42* (2013.01); *B05B 11/0056* (2013.01); *B05B 11/0097* (2013.01);
(Continued)

(58) Field of Classification Search
CPC ..... B65D 83/42; B65D 1/0238; B65D 2251/0096; B05B 11/00412;
(Continued)

(56) References Cited

U.S. PATENT DOCUMENTS 4,448,226 A * 5/1984 Dumont ..... F23Q 2/52 141/2
4,944,432 A * 7/1990 Jouillat ..... B05B 11/0097 222/321.2

(Continued)

FOREIGN PATENT DOCUMENTS

DE 19832824 A1 2/2000
EP 0546898 A1 6/1993

(Continued)

OTHER PUBLICATIONS

Search Report and Written Opinion dated Feb. 7, 2018 for Italian patent application No. 201700056451.

*Primary Examiner* — Timothy L Maust
*Assistant Examiner* — James R Hakomaki
(74) *Attorney, Agent, or Firm* — Vorys, Sater, Seymour and Pease LLP

(57) ABSTRACT

Container, including a body having a neck delimiting an opening for the access to a body cavity, and a containment element having at least one deformable side wall located inside the cavity to contain fluid substance, the interior of the containment element sealedly coupled to a collar having a surface resting on the body and a tubular member, extending from the bottom thereof, defining a first passage for the fluid substance in use, an insert housed within the collar, the insert formed of first and second parts, connected by first breakable portion, a shutter sealedly housed, inside the insert, formed of first and second sections, connected by second breakable portion, the second section including a surface, to cooperate, in a sealed manner, with the tubular member when second section is fitted thereon, and a breakable wall which, when broken, permits access to the containment element.

20 Claims, 5 Drawing Sheets

(51) Int. Cl.
*B65B 31/02* (2006.01)
*B65D 1/02* (2006.01)

(52) U.S. Cl.
CPC .... *B05B 11/00412* (2018.08); *B05B 11/3047* (2013.01); *B65B 31/025* (2013.01); *B05B 11/00444* (2018.08); *B65D 1/0238* (2013.01); *B65D 2251/0096* (2013.01)

(58) Field of Classification Search
CPC ..... B05B 11/0056; B05B 11/0097; B05B 11/3407; B65B 31/025; B65B 11/00444
USPC ..... 141/2
See application file for complete search history.

(56) References Cited

U.S. PATENT DOCUMENTS 5,348,189 A * 9/1994 Cater ..... B05B 7/0031 222/1
5,358,149 A * 10/1994 O'Neill ..... B05B 11/3016 222/321.2
5,417,258 A 5/1995 Privas
5,836,479 A 11/1998 Klima et al.
5,947,340 A * 9/1999 Arnold ..... B05B 11/3016 222/321.9
5,992,704 A * 11/1999 Jager-Waldau ..... B05B 11/0005 222/341
6,530,371 B2 * 3/2003 Jansen ..... A61M 11/06 128/200.19
7,040,511 B1 * 5/2006 Petit ..... B05B 11/3047 222/189.09
7,503,466 B2 * 3/2009 Ramet ..... B05B 11/0059 222/321.9
7,717,302 B2 * 5/2010 Crosnier ..... B05B 11/0059 222/321.2
8,028,862 B2 * 10/2011 Rossignol ..... B05B 11/3004 222/256
2004/0074925 A1 4/2004 Faurie
2005/0029307 A1 2/2005 Py et al.
2006/0243748 A1 * 11/2006 Rampini ..... B05B 11/0041 222/321.2
2006/0261092 A1 * 11/2006 Ophardt ..... B05B 11/306 222/181.1
2017/0036227 A1 2/2017 Muller
2018/0339304 A1 11/2018 Moretti

FOREIGN PATENT DOCUMENTS

EP 2153908 A1 2/2010
EP 2197589 6/2010
EP 2598408 6/2013
FR 2668119 A2 4/1992
FR 2695111 A1 3/1994
FR 2730708 A1 8/1996

* cited by examiner 50
11
10
11A
8
P
S
209
18

B
15B
D1
11B
12
5

F
208

28

15A

CONTAINER OF FLUID SUBSTANCES WITH HERMETIC SEALING SYSTEM AND METHOD OF USE

CROSS REFERENCE TO RELATED APPLICATION

This claims the benefit of Italian patent application no. 102017000056451, filed May 24, 2017, incorporate by reference.

FIELD OF THE INVENTION

The present invention relates to a container of fluid substances and a method for the filling and use thereof.

In particular, it relates to a container of fluid substances of the cosmetic, medical, or food kind, dispensable by means of a manual airless pump.

BACKGROUND ART

In the name of the aforesaid applicant, EP2197589-A1 discloses a container which houses a deformable bag, to which an airless manual pump is coupled for dispensing the fluid contained in the bag.

One problem experienced with these containers concerns the filling of the deformable bag which must be carried out before coupling the container to the pump.

For some fluid products, especially cosmetic or medical products, which must therefore be handled with considerable care, the filling step is critical since it must be carried out using appropriate systems within a controlled environment. In fact, most of these fluids must not come into contact with air or with contaminating environments.

To solve this problem, the filling step and the step consisting of coupling the pump to the filled bag are carried out almost simultaneously and within the same controlled atmosphere environment. In this way, it is certain that there is no contamination of the fluid introduced into the bag, since once the pump is coupled to the container, the system is sealed and hermetic and can no longer be contaminated.

The methodology described above is effective but involves high costs and flexibility problems deriving from the need to provide controlled environments in which two essentially independent steps take place, namely that consisting of filling the container and that consisting of closure (by means of the pump) of the filled container.

FR2730708-A1 and FR2695111-A1 show valve systems applicable to the bag, which are designed to seal off the container and the contents thereof immediately after the filling step, thereby allowing the pump to be coupled later on.

However, these solutions are not very effective as they do not always guarantee good sealing off of the contents of the bag. In fact, the closure of the bag after filling is performed by valves made of an elastic material (silicone, rubber, etc.) which do not guarantee a hermetic seal, especially if the filling pressure is not optimal (for example, when the bag is only partially filled, i.e. with an amount of fluid which is lower than the maximum capacity).

Another problem encountered with the prior art is that the traditional top-fill valves described in the aforesaid patent documents do not envisage the provision, prior to filling, of a container with a bag from which the air has been removed (i.e. vacuum-sealed). In fact, when coupled to a vacuum bag and placed in a room pressure environment, the commonly known valves would open, allowing the entry of (possibly contaminated) air into the bag.

U.S. Pat. No. 5,836,479 A discloses a container, according to the prior art.

SUMMARY OF INVENTION

The object of the present invention is to provide a container and a method for the filling and use thereof which is improved compared with the prior art.

Another object of the invention is to provide a container which, once filled, guarantees optimal sealing off of the fluid substance inside the container, even if the pump is not installed immediately.

This and other objects are achieved by means of a container and a method for the use thereof according to the technical teachings of the claims annexed hereto.

Advantageously, the present invention provides a container which can be equipped, prior to the filling step, with a bag which is depressurised, crushed, compacted, or formless (or rather, vacuum-sealed).

Advantageously, the container according to the present invention also features a plurality of seals which make it possible to verify—both during the filling step and during the pump/container coupling step—whether the container and the fluid contained therein are perfectly intact.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

Figure 1:
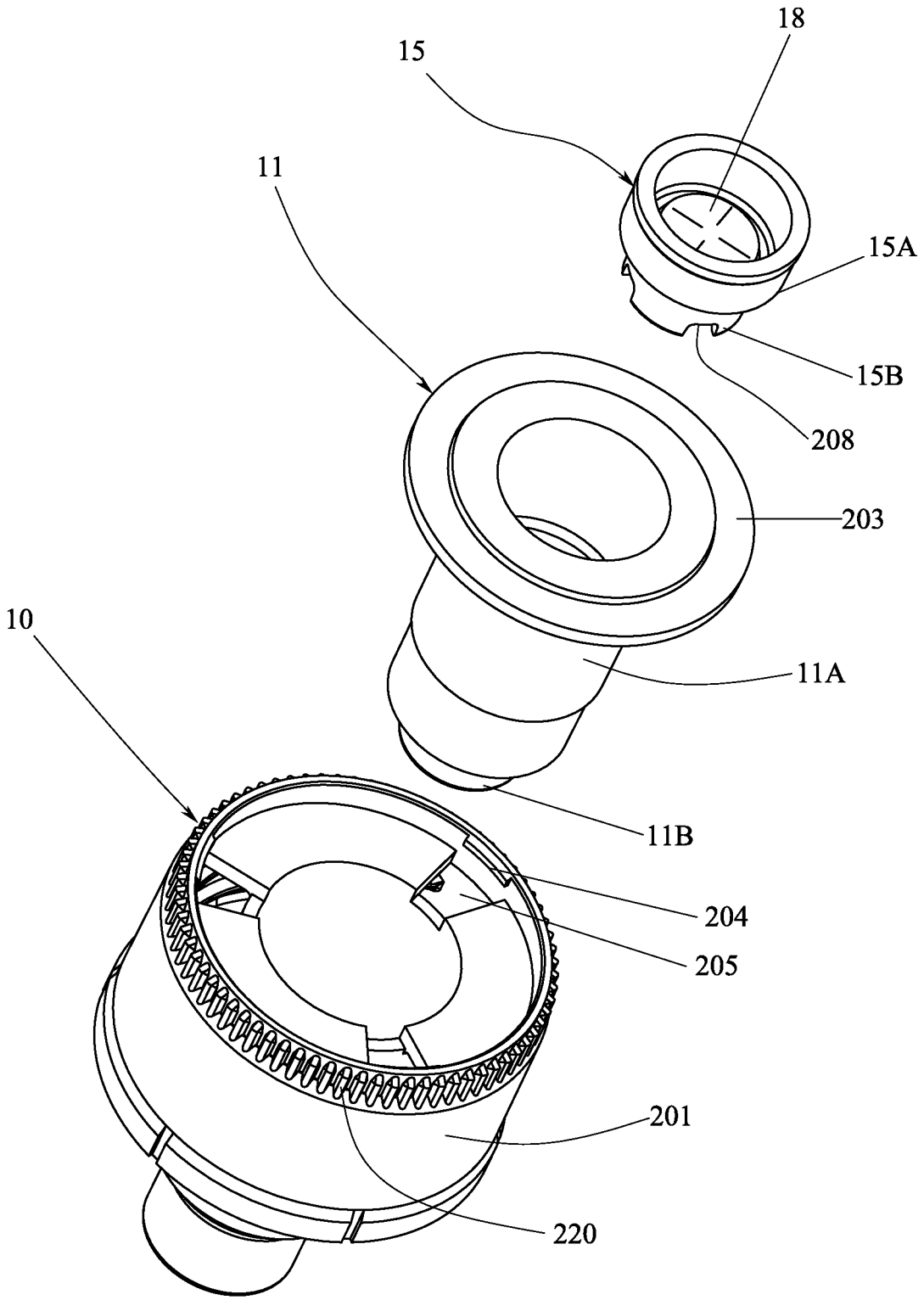
FIG. 1 is an exploded perspective view of a certain parts which form the container according to the present invention.

With reference to the figures stated, reference number 1 is used to denote, as a whole, a container.

The container 1 is configured to contain and dispense (when coupled with a pump) a fluid substance contained therewithin.

In the present document, the term "fluid substance" may be intended as a substance with a liquid or creamy consistency, which may be, for example, a cosmetic cream, a perfume, a medicine, a gel, a lacquer, a hair product, etc.

The container 1 comprises an external body 5 (or recipient), which may be, for example, a vial made of glass or plastic, and may be either transparent or not.

The external body may have a neck 6 delimiting an opening 7 permitting access to a cavity 7A in the said body.

In the figures shown, the neck 6 has a smaller diameter than that of the rest of the recipient, but it is also possible to use vials, bottles etc., with a neck which is essentially flush with the external wall of the recipient, so that the section of the opening delimited by the neck is similar to the maximum internal diameter of the recipient.

Inside the body 5, there is a containment element 8 envisaged, provided with at least one deformable lateral wall.

Merely by way of example, the containment element 8 may be a deformable bag which is very similar to that envisaged in document n. EP2197589-A1.

Figures 3, 4, 4A, 4B, 5:
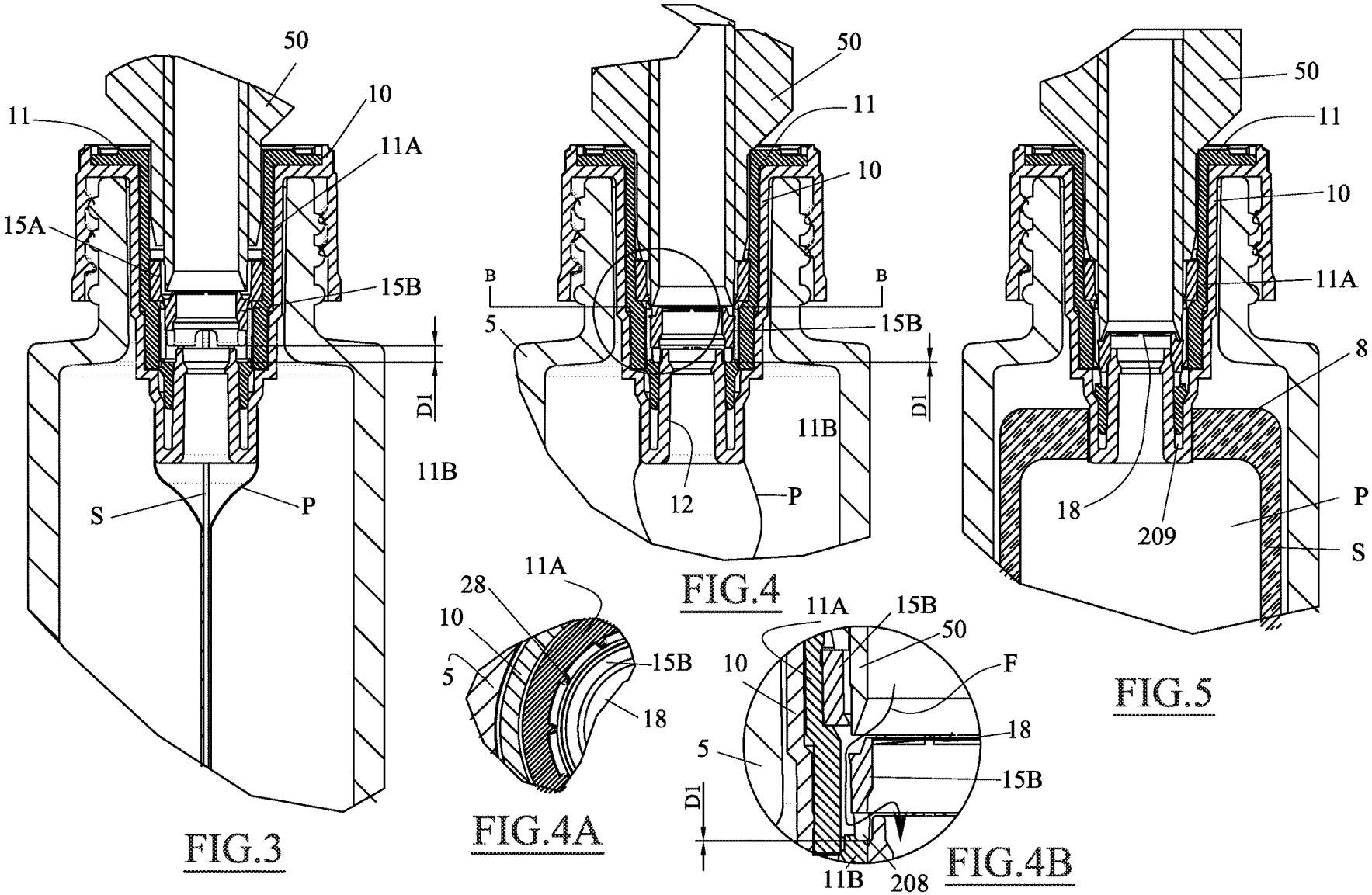
FIGS. 3, 4, and 5 show a sequence of operating steps consisting of the filling of the container according to the present invention.
FIG. 4A is a partial, simplified section taken along line B-B of FIG. 4.
FIG. 4B is an enlarged, simplified representation of the part circled in FIG. 4.

Alternatively, the containment element 8 may be formed of two walls P, made of multilayer films thermally welded together along the perimeter welding lines S (see FIG. 5). A rigid element (for example made of a more rigid plastic than the material comprising the walls) is then coupled to the welded walls (for example by means of thermal welding), thereby establishing a stable access to the space formed between the two welded walls P.

In the embodiment described, the rigid element is a collar 10, which will be described in detail below. Obviously, the rigid element may also be a separate piece from the collar coupled thereto in a stable manner. In the present document, the term 'rigid'—used in reference to the collar—should always be understood as meaning that the collar is more rigid than the bag or containment element.

For example, the multilayer film may be: PE-AL-PE, PE-AL-PA, PE-AL-EVOH, PE-PET-PE, PET-PE, PET-PA-PE, PP-Surlyn, PP-PA-SurLyn, PP-EVOH-PE. These materials offer excellent protection for the substance contained in the bag.

The containment element 8, in a step prior to the filling, may be placed inside the cavity 7A in the body 5 and, as already said, is designed to contain the fluid substance.

For example, the containment element 8 may be formed outside the body 5, either rolled up or compressed in another way, and only inserted into the opening 7 afterwards.

In any case, as already seen, the containment element 8 must be coupled, in a sealed manner, to a collar 10.

In the present document, the term 'coupled in a sealed manner' should be understood as meaning the bag is secured directly or indirectly (as will be seen in the embodiment in FIGS. 8 and 9) to the bag in a sealed manner.

The collar 10 may feature at least one surface 10A resting on the body 5. In the case illustrated, the resting surface may be delimited by a flange 200 formed integrally with the collar 10, from which a skirt 201 may extend, which may surround the neck 6 externally. In this case, the collar 10 is essentially ring-shaped. In this case, the skirt 201 may feature a thread 31 which couples with a counter-thread 32, which may be envisaged on the neck 6. As an alternative to the thread/counter-thread arrangement, other means of coupling between the body 5 and the collar 10 may be envisaged, for example a snap-fit or other coupling.

Figure 2:
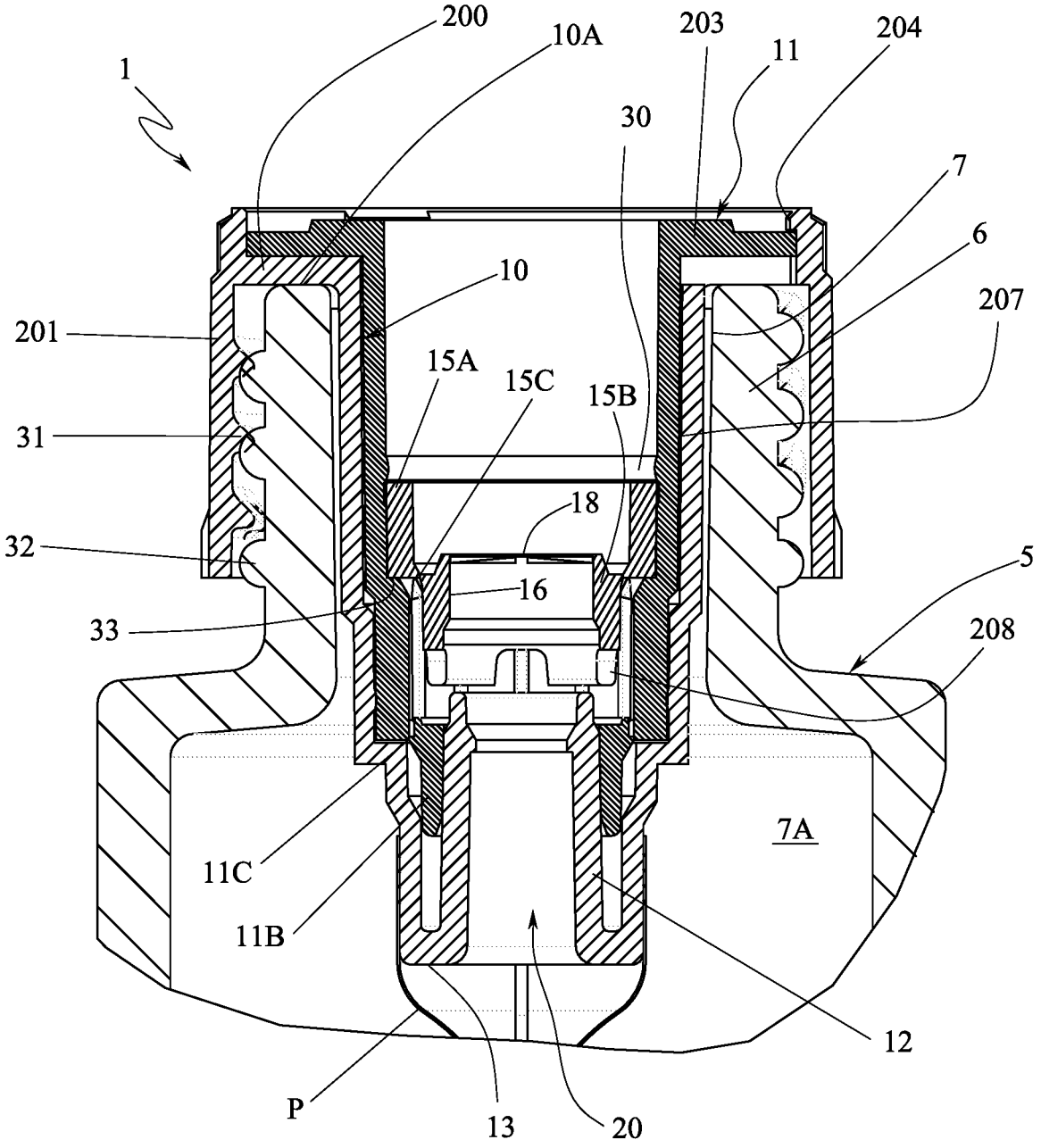
FIG. 2 is a simplified section of the various parts in FIG. 1 assembled together and coupled with a container and a containment element.

As can be seen in FIG. 2, the collar is cup-shaped and from the bottom 13 thereof, a tubular member 12 may protrude, defining a first passage 20 for the fluid substance, in both a filling configuration and a use configuration.

In practice, the passage 20, defined by the tubular member 12, permits access to and from the interior of the containment element 8.

In FIG. 2 (which shows a configuration in which the containment element is empty and may be in a vacuum-sealed or compact condition), it can be seen that the collar 10 houses, in a sealed manner, an insert 11. The seal is, for example, created by means of a tapered coupling on the surface denoted with 207, but it will be seen that it may not be present in other configurations.

The insert 11 is formed of a first part 11A and a second part 11B, which are mutually connected by a first breakable portion 11C.

The insert 11 may also feature a further flange 203, which, besides forming a stop for insert positioning with respect to the collar, can also engage therewith by means of a snap-fit coupling. The teeth 204 which allow such coupling can be seen in FIG. 1. Moreover, recesses 205 can be seen, which facilitate an intake and outlet of air in the cavity 7A, between the containment element 8 and the interior of the body 5.

Also in FIG. 2, it can be seen that there is a shutter 15 housed inside the insert 11, preferably in a sealed manner, formed of a first section 15A and a second section 15B, which are mutually secured by a second breakable portion 15C.

The first section of the shutter 15A may be held in position within the insert 11, on the top, by a rib 30 protruding from an internal surface of the insert 11 and/or by a step 33 on the bottom, featured on an internal surface of the insert 11. The rib 30 may be configured to deform slightly (in an elastic manner) during insertion of the shutter 15 into position in the insert.

In this configuration, i.e. the one shown in FIG. 2, the inside of the containment element 8 is perfectly sealed off from the external environment, and may even be in vacuum-sealed compacted condition. In this condition, insertion of the empty containment element 8 into the body 5 is greatly facilitated.

The configuration shown, furthermore, makes it possible to verify whether the containment element is intact, simply by means of a visual inspection of the condition of the breakable portions of the insert and the shutter.

Returning to the description of the invention, it should be noted that the second section 15B of the shutter plays a very important role in the container 1.

In fact, the said second section comprises a surface 16 configured to cooperate in a sealed manner with the tubular member 12 (for example, with an external surface thereof), when the second section 15B is fitted thereonto.

The second section 15B of the shutter also comprises a breakable wall 18 (which can form its own roof) which, when broken, permits access to the containment element 8.

When, meanwhile, the second section 15B of the shutter is fitted onto the tubular member 12 and the breakable wall 18 is intact, the second section 15B acts as a cap, and the interior of the containment element 8 is perfectly sealed off the external environment. This situation will emerge more clearly later in the description.

The method for filling the container described above is essentially as follows.

Preliminarily, a container is provided in the configuration just described and shown in FIG. 2.

Subsequently, a filling nozzle 50 is provided, which is hollow and is placed resting on the second section 15B of the shutter, as can be seen clearly in FIG. 3.

In this configuration it can be seen that there is a distance D1 between the bottom of the second section 15B of the shutter 11 and the side facing the shutter of the second part 11B of the insert 11.

Subsequently, the second section 15B of the shutter is pushed (by means of the nozzle) until the second breakable portion 15C is broken, thereby separating the first section and the second section of the shutter 15.

It should be noted that during this step, the first section 15A remains firmly in position, as it is abutting against the step 32 on the insert.

The second section 15B of the shutter, meanwhile, can slide towards the tubular member 12, the stroke thereof stopping against the second part 11B of the insert. Regarding this, see FIG. 4, where the distance D1 is zero.

In practice, when the first breakable portion 11C of the insert 11 is intact, the second part 11B constitutes a stop to end the movement of the second section 15B of the shutter.

In the position in FIG. 4, it is therefore possible to dispense the fluid substance from the nozzle until the containment element 8 is filled with the desired amount.

In FIG. 4, it is noted that the walls of the containment element 8 are swelling. In the enlargement in FIG. 4B, one can see the route (arrow F) of the fluid substance during the filling of the containment element 8.

To allow the flow F of the fluid substance, the second section 15B of the shutter 15 may have a lower surface featuring second passages 208 for filling the containment element 8 by means of the tubular member 12. The second passages 208 remains open even when the second section 15B is resting on the said second part 11B of the insert 11.

In the example described, these second passages 208 are arched flow-through cavities, but may have other suitable shapes, such as radial flow-through holes, gaps between specially envisaged fins, etc.

Once the filling operation of the containment element 8 is complete, which (as already mentioned) may also be only partial (depending on the requirements and the amount of the fluid substance one wishes to market), the nozzle is driven further towards the tubular member 12.

The thrust imparted against the nozzle 50 acts against the second section 15B of the shutter, which is resting on the second part 11B. The nozzle thrust continues until the first breakable portion 11C breaks.

At this point, the nozzle movement continues until the second section 15B of the shutter 15 is fitted onto the tubular member 12, forming a cap and thereby closing the first passage 20 in a sealed manner.

Conversely, the second part 11B of the insert, once detached, falls or is forcibly wedged into a recess 209 in the collar 10.

It should be noted that the insert 11 may feature guides 28 (clearly visible in the cross section in FIG. 4A and in FIG. 6) which cooperate with the second section 15B of the shutter 15 when—that is—the second breakable part 15C is broken. The guides keep the second section 15B on the same axis and aligned during the movement thereof induced by the nozzle 50.

Furthermore, to further simplify the mechanics of the movement of the nozzle 50, the second breakable portion 15C may be configured to break under a load lower than that of the first breakable portion 11C.

Figure 6:
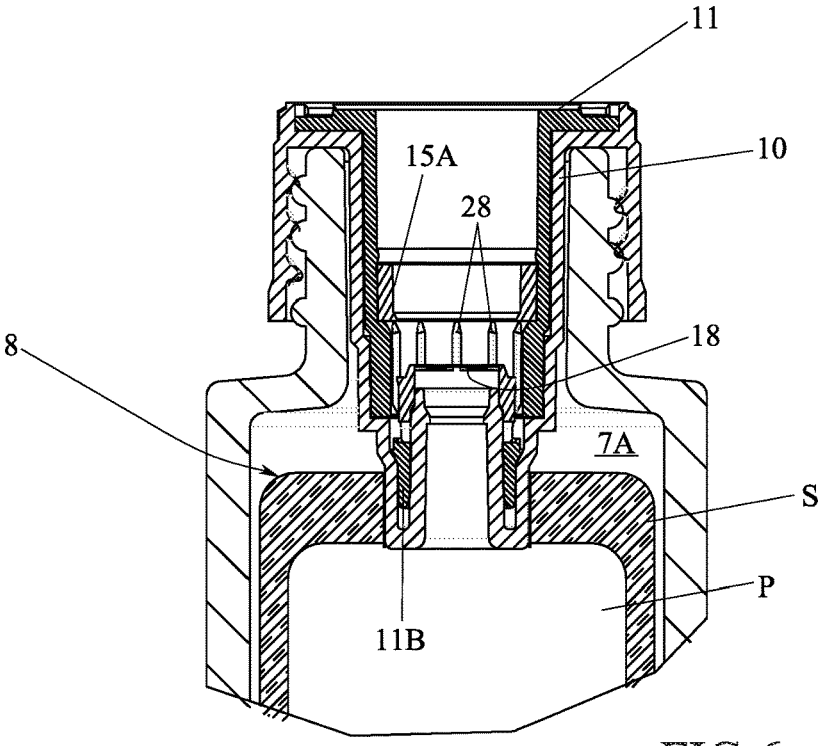
FIG. 6 shows the container in FIG. 1 in a transportation/storage configuration after filling.

At the end of the steps described above, and once the nozzle has been removed, the container 1 is presented as shown in FIG. 6.

As can be seen, in this configuration, the contents of the containment element 8 are perfectly sealed off from the external air, thanks to the presence of the second section 15B of the shutter, which acts as a cap fitted onto the tubular member 12 in a sealed manner.

In the configuration in FIG. 6, the container may be stored, handled, relocated, etc, without the risk of contamination of the fluid substance enclosed therewithin.

It is also possible to verify the contamination status and, at the same time, whether the breakable wall 18 is intact.

Only at the final step of the assembly is it possible to couple a pump (for dispensing the fluid substance) with the container 1.

The pump 100 may be manual and of the airless type (i.e. it does not allow air to enter the containment element 8 during the operation thereof). The said pump may be configured for creams, such as that illustrated, or be equipped with a known spray-dry nozzle of a conventional kind.

Figure 7:
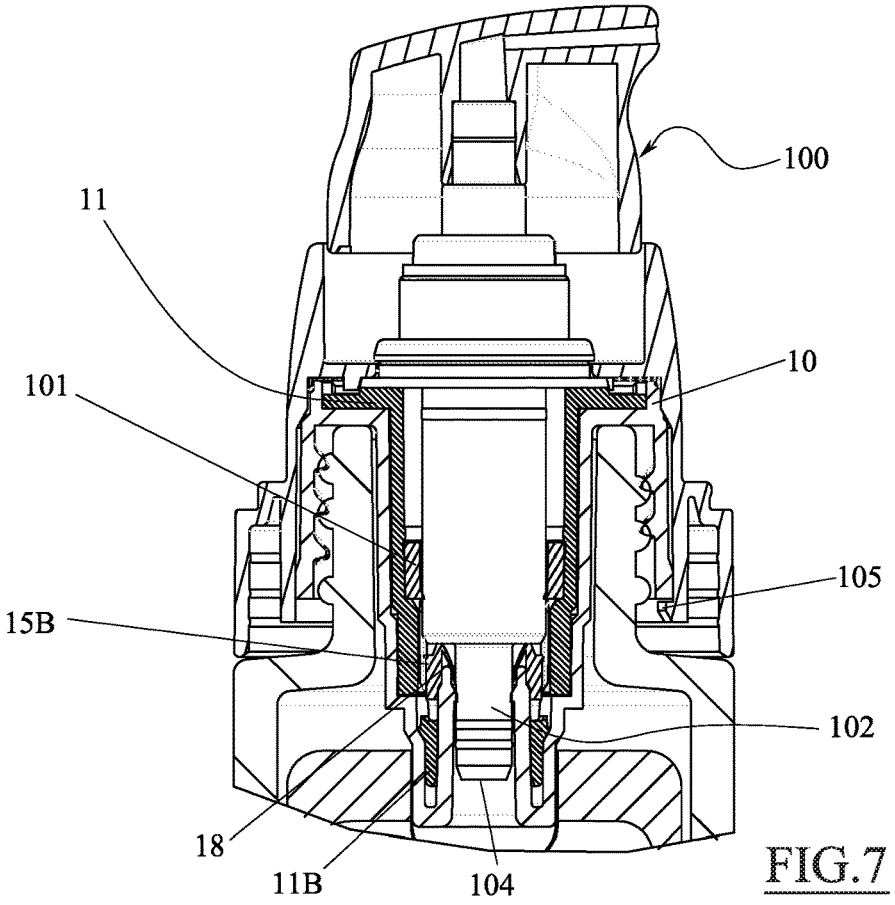
FIG. 7 is a section of the fastening in FIG. 6 once a dispensing pump has been coupled.

To switch from the configuration in FIG. 6 to that in FIG. 7, one simply has to forcibly push the end 104 of a dip tube 102 (part of the dispensing pump 100) against the breakable wall 18 of the second section 10B of the shutter 15, so that the said end breaks the said wall, allowing the dip tube to be in contact with the contents of the containment element 8. Advantageously, the dip tube end 104 is configured to enter, at least partially, the tubular member 12.

Furthermore, the pump 100 may be sealed onto the insert either by means of a specially provided seal 101 or directly with the internal surface of the tubular member 12.

In the case of the pump illustrated, the said pump is fitted onto the collar 10 (or retaining ring) and is snap-fastened thereonto by means of suitable fastening teeth 105.

Furthermore, the pump couples to the collar 10 (or retaining ring) torsionally, for example by means of a toothed profile 220.

In this way, once the fluid substance has been dispensed entirely, it is possible to unscrew the pump, thereby extracting the now empty containment element 8 from the body 5 (which may be made of glass). This possibility facilitates the final disposal of the container/pump.

Obviously alternative solutions may be envisaged in which the collar 10 is devoid of the skirt 201 and does not act as a retaining ring. In this case, the collar flange 10 can snap-fit onto a part of the pump, which is—in turn—equipped with a thread for coupling to the thread featured on the neck of the body 5. Also this configuration allows correct disposal of the container/pump.

It should be noted that a system such as the one described above allows a containment element 8 to be filled and transported easily even in the event that the said element is outside the body 5.

Figure 8:
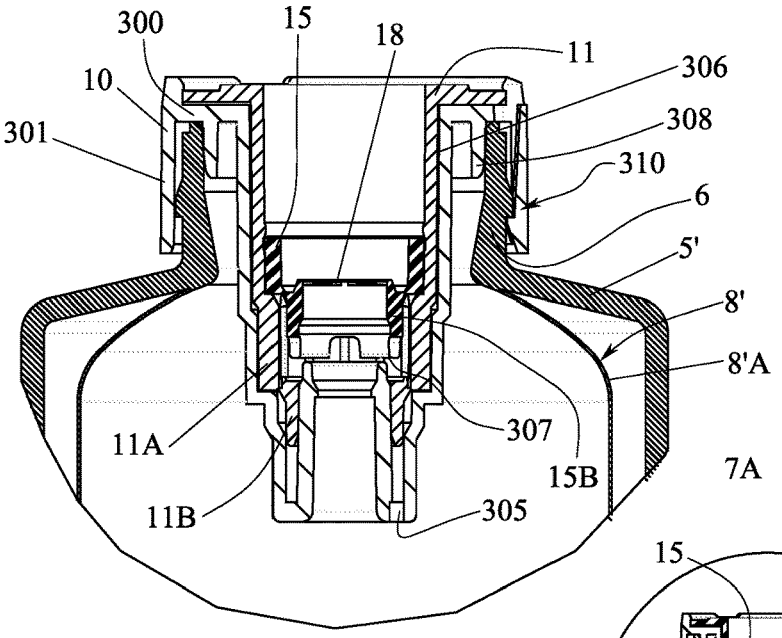
FIG. 8 shows an enlarged detail of the part circled in FIG. 9.
Figure 9:
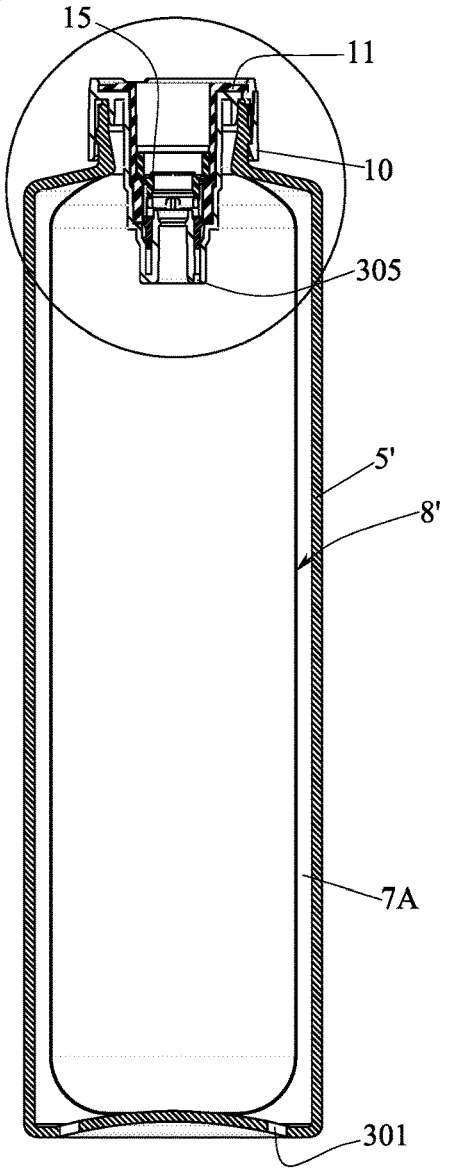
FIG. 9 shows a variant of the container according to the present invention.

A variant of the embodiment stated above is shown in FIGS. 8 and 9. In the said figures, the same reference numbers used earlier are used to denote parts that are functionally similar to those already illustrated, which will, therefore, not be described further.

In this embodiment, the container 5' is formed by blowing a pre-heated test tube made of a multilayer plastic material. The said container features a more internal layer 8'A which is essentially independent from the rest of the container 5' and is secured only lightly (during the step consisting of the production of the test tube) to the external layers of the container 5'. Once the container 5' has been blown, one simply has to introduce the compressed air through suitable air intake/expulsion holes 301 (on the bottom thereof for example), to remove the most internal layer 5'A of the container 5' from the others.

A deformable bag 8' (or containment element 8') is therefore formed, which is entirely similar to that described above but, in practice, is formed as a single piece including at least the neck 6 of the container 5' (as can be clearly seen in FIG. 8).

Therefore, in this embodiment, the collar 10 is coupled, in a sealed manner, to the containment element 8' (or better the interior thereof) by means of a sealing lip 308 which interfaces with the neck 6 of the container 5'. The collar 10 is therefore indirectly coupled, in a sealed manner, with the internal bag of which the neck 6 is an integral part.

It must be said that, in a configuration such as the one illustrated, it is very difficult to provide a depressurised bag before filling, since the rigidity thereof prevents the said bag being compacted as well as the bags obtained by blowing or those obtained from sheets of multilayer material welded around the perimeter thereof.

The collar 10 also features snap-fit means 310 for fastening the said collar to a tooth envisaged externally to the neck 6 of the container (instead of the thread described in the previous embodiment).

The operation of the collar 10, insert 11, and shutter 15 in this embodiment is very similar to that already described above with reference to FIGS. 3-5.

As can be seen from FIG. 8, it is possible to envisage, in addition to that described so far, a ventilation passage 305, on the bottom of the collar connected to the interior of the containment element 8. The passage 305 has the purpose of allowing the evacuation of the air present in the bag 8' to the exterior during the filling step. More specifically, the ventilation passage 305 releases the air between the collar 10 and the insert 11 (between which, therefore, there is no sealed coupling), through a specially provided interstice 306, and the ventilation passage 305 is open only when the second part 11B of the insert is far from the bottom of the glass.

With a definitive closure of the second section 15B of the shutter on the tubular member 12, the second part 11B of the insert is pushed towards the bottom of the collar by the lower edge 307 of the second section 15B.

In this way, the second part 11B of the insert can seal the ventilation passage 305. In this configuration, the closure of the passage 305 may be brought about by sealing the second part 11B between the exterior of the tubular member 12 and the surface of the collar 10 which the said member is facing.

Obviously, in other embodiments, the passage 305 may be envisaged in other parts of the collar 10, and the closure thereof following the filling of the containment element may be brought about with other methods.

Ending the description, it should be noted that the various components of the container may be made of any material suitable for the purpose.

For example, the body 5 (or external container) may be made of plastic, glass, metal, or another suitable material.

The collar 10, the insert 11, and the shutter 15, meanwhile, may be made by moulding plastics, each one being made as a single piece. Preferred plastic materials may be:

for the collar 10: PP/PE for the insert 11: PP/PE/HDPE/LDPE/TPE/TPU for the shutter 15: PP/PE/HDPE/LDPE/TPE/TPU In particular, the breakable wall 18 of the second portion 15B of the shutter may be a wall made of the same material as the shutter but thinner. The thinner wall may be obtained by adjusting the mould to create a thin cavity to house a thin layer of plastic. The surface of the breakable wall may feature scoring (for example in the shape of a Greek cross) to facilitate cutting.

Furthermore, the breakable portions of the shutter and the insert may be obtained by means of calibrated thinning of the constituent material of the insert and the shutter or with a mechanical pre-scoring of the plastic during the system assembly step.

Lastly, all the seals described above, and in particular those between the insert 11 and the collar 10, those between the insert 11 and the shutter 15, and those between the second section of the shutter and the tubular member 12, are obtained by exploiting the coupling tolerances of the various pieces and the slight deformation of the plastics in mutual contact. For example, it is possible to use a sealing system with a toroidal section with sections that deform and adapt to surfaces during the sliding steps (during assembly).

Various embodiments of the innovation have been disclosed herein, but further embodiments may also be conceived using the same innovative concept.

The invention claimed is:

1. A container for a fluid substance, comprising a body having a neck delimiting an opening for access to a cavity of the body itself, and a containment element having at least one deformable side wall located inside the cavity and intended to contain the fluid substance, the interior of the containment element being associated in a sealed manner to a collar having at least one resting surface on the body and a tubular member extending from its bottom, the tubular member defining a first passage of the fluid substance during use, within the collar an insert being located, formed by a first and a second part mutually connected by a first breakable portion, wherein inside the insert is located a shutter formed by a first section and a second section mutually connected by a second breakable portion, the second section comprising a surface configured to cooperate with the tubular member when the second section is fitted on the tubular member and a breakable wall through which, when the breakable wall is broken, access within the containment element is permitted.

2. The container according to claim 1, wherein the insert is secured to the collar by a snap coupling and/or in which a seal is provided between the insert and the collar.

3. The container according to claim 1, wherein the first section of the shutter is held in position within the insert by a rib protruding from an inner surface of the insert and/or by a step provided on an inner surface of the insert.

4. The container according to claim 1, wherein the collar comprises a skirt which surrounds the neck externally, and/or wherein a thread is provided on the collar and a counter-thread is provided on the neck.

5. The container according to claim 1, wherein the second part of the insert, when the first breakable portion is unbroken, forms a stop for the second section of the shutter when the second breakable portion is broken and said second section is pushed in the direction of the tubular member.

6. The container according to claim 1, wherein the second section of the shutter has a lower surface provided with second filling passages of the containment element through the tubular element, said passages being opened when the second section is resting on the second part of the insert.

7. The container according to claim 1, wherein the insert comprises guides cooperating with the second section of the shutter at least when the second breakable portion is broken.

8. The container according to claim 1, wherein the second breakable portion is configured to break at a lower load than that at which breaks the first breakable portion.

9. The container according to claim 1, comprising a dispensing pump comprising at least one feature selected from the group consisting of:

a dip tube provided with an end configured to break through the breakable wall, a dip tube provided with an end configured to penetrate at least partially in said tubular member, wherein the pump comprises a seal with the insert, and wherein the pump comprises fixing elements at least to the collar.

10. The container according to claim 1, wherein the collar comprises a closable passage for venting the air trapped in the containment element during its filling, and/or wherein an air vent is provided by at least one interstice present between the body and the insert.

11. A method for filling a container according to claim 1, wherein a hollow filling nozzle is predisposed in contact to the second section of the shutter, and subsequently:

the second section of the shutter is pushed through the nozzle until the second breakable portion is broken and, the second section of the shutter is pushed until it rests on the second part of the insert;

the fluid is delivered by the nozzle until it fills the containment element;

the second section of the shutter that rests on the second part of the insert, is pushed by the nozzle until the first breakable portion is broken and the nozzle movement continues until the second section is fitted on a collar tube, thus closing the first passage.

12. The method according to claim 11, wherein an end of a dip tube of a dispensing pump is pushed against the breakable wall of the second section of the shutter to break it, to allow the pump to suck the content of the containment element.

13. The method according to claim 11, wherein the insert is secured to the collar by a snap coupling and/or in which a seal is provided between the insert and the collar.

14. The method according to claim 11, wherein the first section of the shutter is held in position within the insert by a rib protruding from an inner surface of the insert and/or by a step provided on an inner surface of the insert.

15. The method according to claim 11, wherein the collar comprises a skirt which surrounds the neck externally, and/or wherein a thread is provided on the collar and a counter-thread is provided on the neck.

16. The method according to claim 11, wherein the second part of the insert, when the first breakable portion is unbroken, forms a stop for the second section of the shutter when the second breakable portion is broken and said second section is pushed in the direction of the tubular member.

17. The method according to claim 11, wherein the second section of the shutter has a lower surface provided with second filling passages of the containment element through the tubular element, said passages being opened when the second section is resting on the second part of the insert.

18. The method according to claim 11, wherein the insert comprises guides cooperating with the second section of the shutter at least when the second breakable portion is broken.

19. The method according to claim 11, wherein an end of a dip tube of a dispensing pump is pushed against the breakable wall of the second section of the shutter to break it, to allow the pump to suck the content of the containment element and the pump is fixed at least to the collar.

20. An apparatus comprising the container according to claim 1 and a pump, the container for transporting and the filling of the container before installing the pump, and the container is independent from the pump itself.

* * * * *